US006209558B1

(12) United States Patent
Viglione

(10) Patent No.: US 6,209,558 B1
(45) Date of Patent: Apr. 3, 2001

(54) FOLDABLE TENT

(76) Inventor: Guiseppe Viglione, Lot 31 Koala Way, Horsley Park, NSW 2164 (AU)

( * ) Notice: Subject to any disclaimer, the term of this patent is extended or adjusted under 35 U.S.C. 154(b) by 0 days.

(21) Appl. No.: 09/180,655

(22) PCT Filed: May 14, 1997

(86) PCT No.: PCT/AU97/00296

§ 371 Date: Dec. 4, 1998

§ 102(e) Date: Dec. 4, 1998

(87) PCT Pub. No.: WO97/43509

PCT Pub. Date: Nov. 20, 1997

(30) Foreign Application Priority Data

May 15, 1996 (AU) ..... PN9868

(51) Int. Cl.[7] ..... E04H 15/38

(52) U.S. Cl. ..... 135/132; 135/151; 135/153; 135/144

(58) Field of Search ..... 135/130, 131, 135/132, 136, 151, 154, 143, 144

(56) References Cited

U.S. PATENT DOCUMENTS

| | | | | |
|---|---|---|---|---|
| 1,434,841 | * | 11/1922 | Pittoni | 135/154 X |
| 2,853,088 | * | 9/1958 | Lamborn | 135/132 |
| 2,960,993 | | 11/1960 | Holmstrom | 135/4 |
| 3,171,417 | * | 3/1965 | Stokes | 135/132 |
| 3,405,721 | | 10/1968 | Crosler | 135/7.1 |
| 3,563,257 | * | 2/1971 | Cummins | 135/131 |
| 3,865,123 | * | 2/1975 | Bracken | 135/132 |
| 4,612,948 | | 9/1986 | Simpson | 135/112 |
| 4,748,995 | | 6/1988 | Viglione | 135/109 |

FOREIGN PATENT DOCUMENTS

| | | |
|---|---|---|
| 3855678 | 2/1980 | (AU) . |
| 0364646 | 4/1990 | (EP) . |

* cited by examiner

*Primary Examiner*—Carl D. Friedman
*Assistant Examiner*—Winnie Yip
(74) *Attorney, Agent, or Firm*—Norris, McLaughlin & Marcus P.A.

(57) ABSTRACT

A foldable tent (10) comprising a frame (11) with a cover (12) and ground sheet (13) affixed thereto. The frame comprises a plurality of U-shaped frame members (14), each having a base (25) from which extend two arms (26& 27). The group of arms (26) are pivotally connected to each other, as are the group of arms (27). Each arm (26& 27) is rigidly attached to a base end member (32& 33) which is pivotally connected to the base (25), whereby in the folded position the arms (26& 27) fold parallel to the base (25) with the end members (32& 33) preferably lying normal to the base (25) and the arms (26& 27).

8 Claims, 3 Drawing Sheets

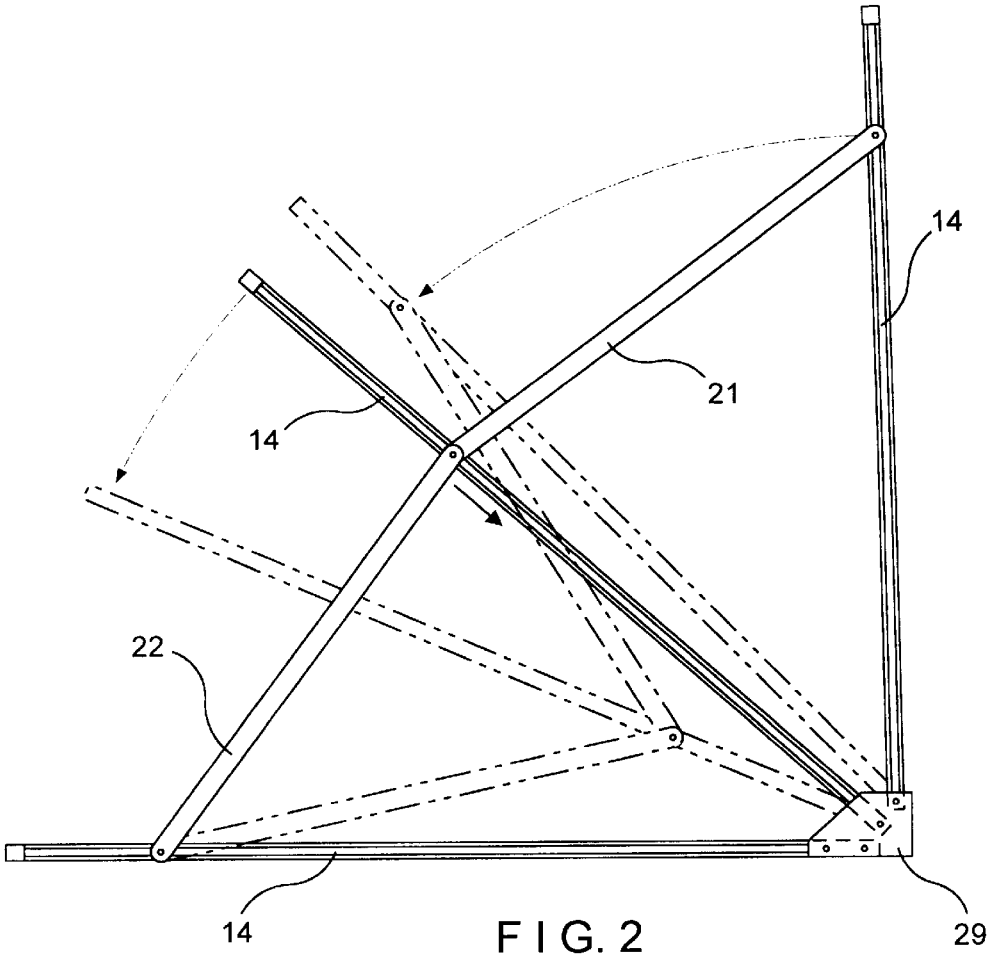
FIG. 2
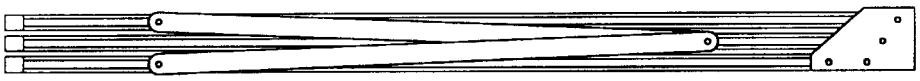
FIG. 3
FIG. 4
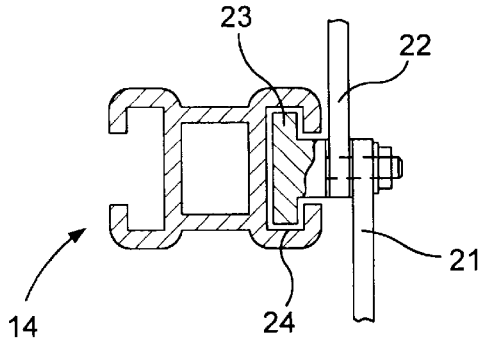

FOLDABLE TENT

BACKGROUND OF THE INVENTION

1. Field of the Invention

The present invention relates to the construction of tent frames, and more particularly to the construction of a tent with its covering material fixed to the frame to facilitate quick and easy erection of the tent.

It is a general disadvantage of known tents that they are generally complex and therefore difficult and time consuming to erect. Also this adds to the manufacturing costs.

2. Description of the Related Art

Many attempts have been made to provide a tent which is both easily erected and of simple construction. The following is a list of such attempts.

U.S. Pat. No. 2,960,993 discloses a tent having U-shaped frame members, which are of a telescoping construction, to assist in the folding of the frame, with the cover sheet fixed to the frame. The telescoping nature of the frame members makes the tent construction generally complex, and the erection is not straight forward and is generally time consuming.

U.S. Pat. No. 3,405,721, discloses a tent having U-shaped frame members, but the cover sheet and ground sheet are affixed to the frame after the frame has been erected. Thus the erection of the tent is not straight forward and is generally time consuming.

U.S. Pat. No. 3,865,123 discloses a tent which has a frame of a generally U-shaped construction, but has a zipper fastener on the ground sheet to facilitate folding of the frame. Again this adds to the cost and complexity of the tent.

U.S. Pat. No. 4,748,995, by Guiseppe Viglione, overcomes most of the disadvantages of the prior art. However the present invention provides an improvement of this U.S. patent in that it provides a tent of the same folded size as an equivalent tent made in accordance with U.S. Pat. No. 4,748,995, but which folds out to a larger size.

SUMMARY OF THE INVENTION

In one broad form the invention comprises a foldable tent comprising:

a frame;

and a cover and ground sheet fixed to the frame so as to provide an enclosed living area when said tent is erected, said frame comprising a plurality of frame members, each of generally U-shaped configuration, with an elongated base having two arms extending therefrom, with the arms cooperating to form two frame sides, a pivot assembly for each frame side to which the free ends of the arms of the respective side frames are attached so that the arms of each frame side pivot about a first folding axis on said respective pivot assembly, whereby said frame members are pivotal from a first folded position, wherein said frame members are in a an abutted relationship, to an erected position in which the frame members are angularly spaced about said first folding axes, brace means extending between said frame members to support the frame members in the erected position, an end member located at each end of the base and pivotally connected thereto, wherein the respective arms are rigidly connected to the extremity of the respective end member, thereby enabling pivoting of the end member and attached arm, about a second folding axis extending generally within the plane of the respective base and normal to the direction of extension of the base member and the arm, whereby in the erected position the arms project away from the base, with the second axes of the arms of a side being generally coterminous when the tent is folded, the end members of the first side being longer than the end members of the second side so that in the folded position the arms of the second side lies between the bases and the arms the first side.

BRIEF DESCRIPTION OF THE DRAWINGS

A preferred form of the invention will now be described with reference to the accompanying drawings, in which:

FIG. 2 is a schematic side view of the tent shown in FIG. 1;

FIG. 3 is a schematic view of the frame of the tent shown in FIG. 1, in a partially folded position, FIG. 4 is a schematic sectional end view of the bracing employed in the tent shown in FIG. 1;

DESCRIPTION OF THE PREFERRED EMBODIMENTS

Figure 1:
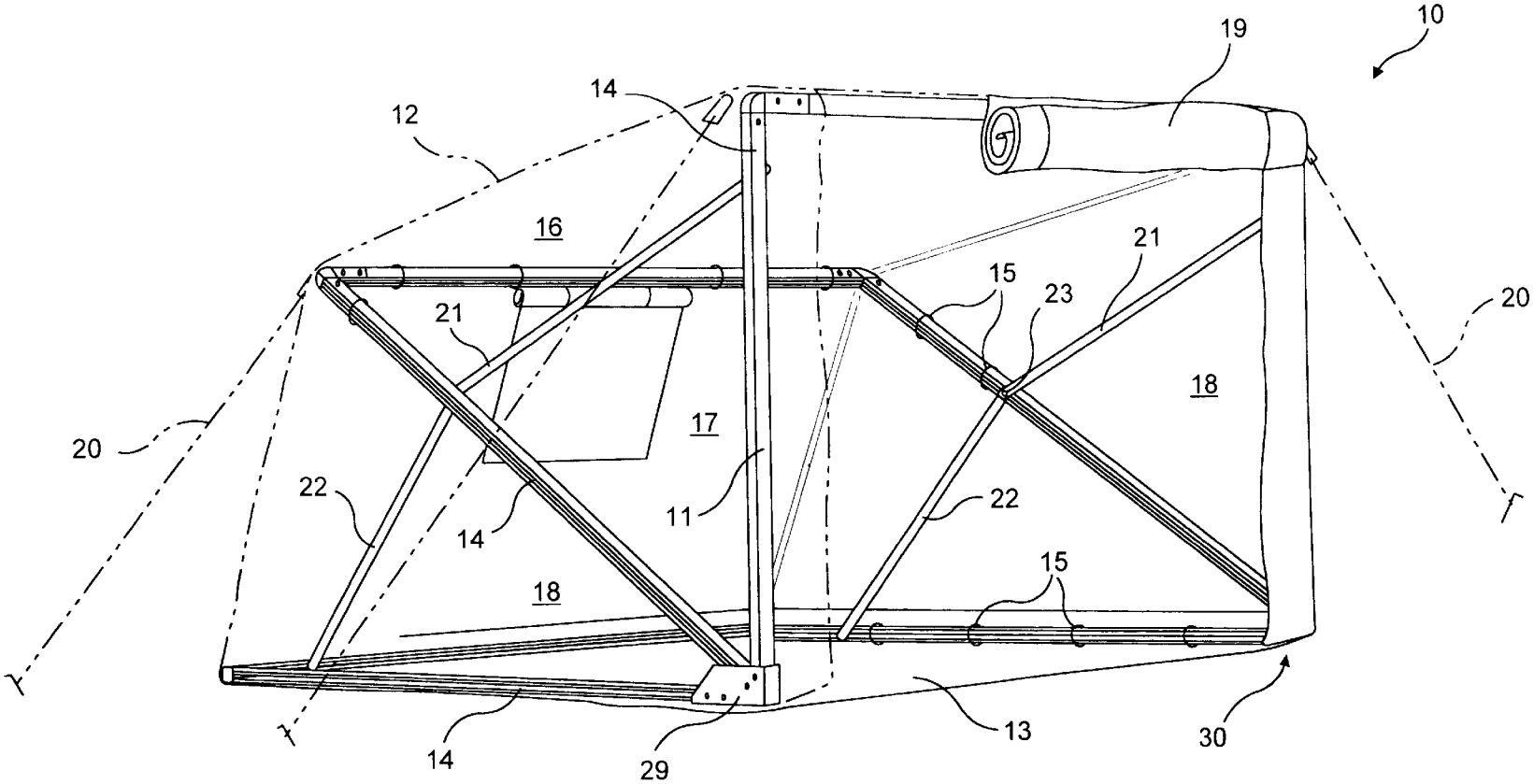
FIG. 1 is a schematic perspective view of a foldable tent according to one embodiment of the present invention.

In FIG. 1 there is schematically depicted a tent (10) having a frame (11) which supports a cover sheet (12) which rest upon a ground sheet (13). The frame (11) comprises a plurality of frame members (14), each of general U-shaped configuration. The frame members (14) are formed of metal tubing having a rectangle or square cross section. The cover sheet (12) and the ground sheet (13) are permanently fixed to the frame members (14) by straps (15).

The sheet (12) provides a roof surface (16), a rear wall (17) and two side walls (18). The front wall of the tent (10) is provided with one or more foldable panels (19) which provide access to the interior of the tent.(10).

It should be appreciated that the tent (10) is self supporting and will generally not require anchoring to the ground. However if the weather conditions so require it, the tent (10) could be tied down by means of lines (20). Still further the ground sheet (13) could be provide with eyelets adjacent its periphery through which pegs could be driven to further aid in anchoring the tent (10) to the ground.

The frame members (14) are held in an erected position by means of braces (21 & 22). One extremity of the brace (22) is pivotally attached to the frame member (14) resting on the ground while one extremity of the brace member (21) is pivotally attached to the frame member (14) which is generally vertically extending, as shown in FIG. 2. The other two extremities of the braces (21 & 22) are attached to a slide (23), slidably received in a channel (24) defined in the frame member (14), as shown in FIG. 4.

Figure 7:
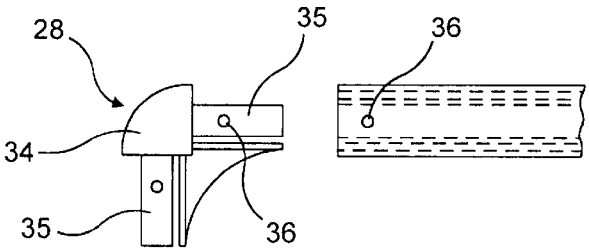
FIG. 7 is a schematic view of a corner assembly of the frame shown in FIG. 2.

Each of the frame members (14) is of generally U-shaped configuration so as to have an elongated base (25) from which extends two arms (26 & 27). Each of the arms (26 & 27) can be attached to its associated base (25) by means of a corner assembly (28), as shown in FIG. 7.

The extremities of the arms (26) are pivotally attached to a pivot assembly (29) while the extremities of the arms (27) are pivotally attached to a pivot assembly (30). Thus the frames 14 are able to pivot about the same or a plurality of parallel axes so as pivot from an erected position as shown in FIG. 2 to a folded position as shown in FIG. 3. Preferably the ground engaging member (14) fixed to the pivot assemblies (29 & 30).

Figure 5:
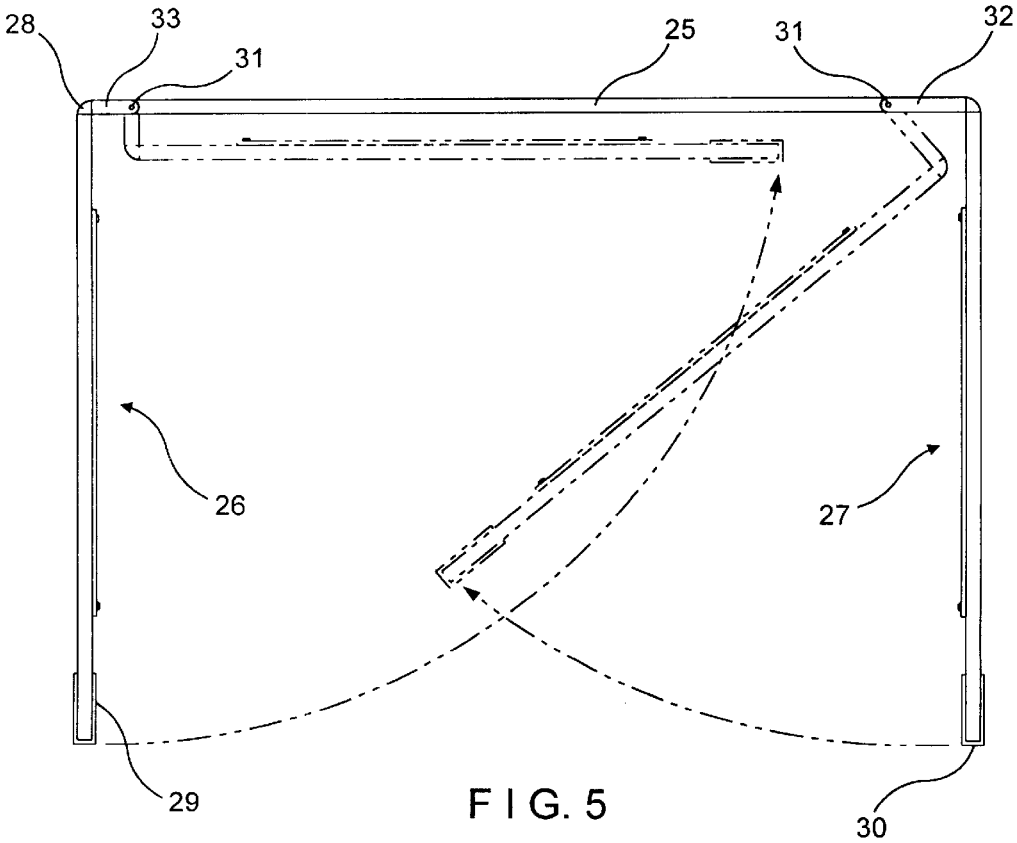
FIG. 5 is a schematic plan view of the frame shown in FIG. 2, in a partially folded position.
Figure 6:
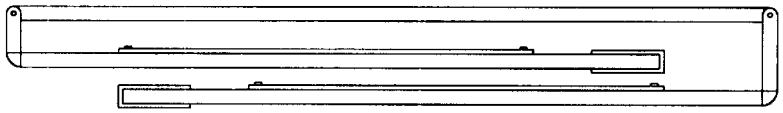
FIG. 6 is a schematic plan view of the frame shown in FIG. 2, in a completely folded position.

Each of the arms (26 & 27) are rigidly attached to the respective base end members (32 & 33), which are pivotally attached to the base (25) by means of pins (31). The pins (31) define pivot axes normal to the axis or axes defined by the pivot assemblies (29 & 30). The end member (32) is longer than the end member (33). The relative lengths of the portions (32 & 33) enables folding of the legs (26 & 27) to the position shown in FIG. 5 with the cover sheet (12) and the ground sheet (13) still attached to the frame.

Each corner assembly (28) comprises a corner member (34) having two projections (35), which mate within the associated member to be joined. Fasteners are then passed through the holes (36) to effect a join.

Because the arms (26 & 27) and their respective base end members (33 & 32) pivot from positions along the base (25), a fully folded tent of less length than the length of the base is obtained. Further a larger tent, made in accordance to the present invention compared to that made in accordance to U.S. Pat. No. 4,748,995, can be folded out from the same length folded package.

It should be obvious to people skilled in the art that variations and modifications can be made to the above description without departing from the scope or spirit of the present invention.

The claims defining the invention are:

1. A foldable tent comprising:

a frame;

and a cover and ground sheet fixed to the frame so as to provide an enclosed living area when said tent is erected;

said frame comprising a plurality of frame members each of a generally U-shaped configuration;

each frame member having an elongate base member having a first and second end and two elongate arms extending respectively from said ends, such that said arms of respective frame members when erected cooperate to form first and second frame sides;

each frame side having a pivot assembly to which the free ends of the arms of the respective side frames are attached so that the arms of each frame side pivot about a first folding axis on said respective pivot assembly, whereby said frame members are pivotal from a first folded position, wherein said frame members are in an abutted relationship, to an erected position in which the frame members are angularly spaced about said first folding axes, brace means extending between said frame members to support the frame members in the erected position;

first and second end members located respectively at said first and second ends of said base member and pivotally connected thereto, wherein the respective arms are rigidly connected to the extremity of the respective end member, thereby enabling pivoting of the end member and attached arm, about a second folding axis extending generally within the plane of the respective base member and normal to the direction of extension of the base member and the arms, whereby in an erected position the arms project away from the base member, the end members lie colinearly to the respective elongated base member and when the tent is in a folded position the arms are generally parallel to said base member, wherein the first end members of the first frame side are longer than the second end members of the second frame side such that in the folded position the arms of the second frame side lie between the base members and the arms of the first frame side.

2. A foldable tent according to claim 1 wherein said brace means comprises rigid brace members pivotally attached to a frame member and at another end of said brace member attached to another of said brace members and a slide, which slide travels along an intermediate frame member so that when said tent is in said erected position, said slide has travelled past an over centre position, whereupon one of the frame members provides a generally upwardly extending end face of the tent.

3. A foldable tent according to claim 1 wherein each of said frame members are substantially identical and one of said frame members is adapted to rest on a ground surface and is fixed to said pivot assemblies.

4. A tent according to claim 3, wherein there are three of said frame members comprising a floor frame member, an intermediate frame member and an end face member, and each side of said tent has a pair of brace members forming said brace means, with a first of each pair extending between said floor frame member and said intermediate member, and the other of said pair extending between said intermediate member and said end face member.

5. A foldable tent according to claim 4, wherein the brace members of each side are each pivotally attached to said frame members and are further slidably attached to said intermediate frame members.

6. A foldable tent according to claim 1, wherein said cover and ground sheet are sealingly affixed together.

7. A foldable tent according to claim 1, wherein the frame members are formed of tubing of rectangular cross-section.

8. A foldable tent according to claim 1, wherein the arms of the frame members extend at right angles from the respective end members.

* * * * *